US005551532A

United States Patent [19]

Kupersmith

[11] Patent Number: 5,551,532

[45] Date of Patent: Sep. 3, 1996

[54] METHOD FOR TRANSMITTING MESSAGES IN AN ELEVATOR COMMUNICATIONS SYSTEM

[75] Inventor: Bertram F. Kupersmith, Avon, Conn.

[73] Assignee: Otis Elevator Company, Farmington, Conn.

[21] Appl. No.: 203,139

[22] Filed: Feb. 28, 1994

[51] Int. Cl.[6] ..... B66B 3/00

[52] U.S. Cl. ..... 187/391; 187/247; 371/20.6; 340/825.05

[58] Field of Search ..... 187/391, 393, 187/247, 248; 340/825.01, 825.05; 371/11.1, 11.2, 20.1, 20.6

[56] References Cited

U.S. PATENT DOCUMENTS

| | | | |
|---|---|---|---|
| 4,363,381 | 12/1982 | Bittar | 187/29 R |
| 4,596,982 | 6/1986 | Bahr et al. | 340/825.05 |
| 4,815,568 | 3/1989 | Bittar | 187/127 |
| 5,081,452 | 1/1992 | Cozic | 340/825.5 |
| 5,084,863 | 1/1992 | Guezou et al. | 370/16.1 |
| 5,200,949 | 4/1993 | Kobayashi | 370/16 |
| 5,202,540 | 4/1993 | Auer et al. | 187/247 |
| 5,272,287 | 12/1993 | Meguerdichian et al. | 187/247 |

*Primary Examiner*—Robert Nappi

[57] ABSTRACT

In a two-way ring elevator communications system, characterized in that a controller is associated with each elevator to process inter-elevator messages and the controllers of the elevators are linked together in serial fashion on a two-way communications system so that the messages of each controller are passed along to and processed by each of the other controllers in two directions on two independent rings, whichever of the two rings is properly functioning is used at full capacity but if neither ring is properly functioning then both rings are operated at reduced capacity, the reduction being carried out by reducing the time between reassignments of elevator hall calls.

5 Claims, 4 Drawing Sheets

METHOD FOR TRANSMITTING MESSAGES IN AN ELEVATOR COMMUNICATIONS SYSTEM

TECHNICAL FIELD

The present invention is related to an elevator communications system of the multiple-ring type, and in particular, a method for increasing the communications capacity of such a system.

BACKGROUND OF THE INVENTION

The architecture of an elevator control systems normally consists of an elevator controller for each elevator to perform elevator-related signaling and motion functions and a separate group controller to perform group-related signaling and dispatching functions. Group control functions are those functions relating to the response of several elevators to hall calls. The weak point of such a system architecture is the group controller. If the group controller fails, there is no further response to group signals, such as hall calls. To guarantee further group controlling in the case of a group failure, at least a second group controller has to be provided, with additional circuitry to detect a group failure and switch through the second (redundant) group controller.

An alternative communication system is described in U.S. Pat. No. 5,202,540, "Two-way Ring Communication System for Elevator Group Control". According to this patent, each elevator controller in a multi-elevator system provides two serial asynchronous full duplex input/output channels to communicate with the next and previous elevator controllers. These two channels allow the transmission of a message in two opposite directions on a communication ring. A single interruption of the ring, via an interrupted transmission line or a disturbed elevator controller, for example, guarantees the transmission of messages to each elevator controller in at least one of the two directions. Further, using a ring architecture allows distributing the group control function across several or all elevators, so that failure of an elevator controller does not result in failure of all group control functions.

This ring communication system has advantages in robustness and system reliability but is inherently inefficient because all messages are transmitted twice and processed twice by each node, i.e., each elevator controller, on the ring. This puts a large burden in communications processing on the CPUs of the nodes. It would be desirable to find a way to use only one ring if a) a method could be found to reliably determine the health/status of each ring and to do proper switching between them and/or b) use both if necessary as originally designed but with a degradation in function to limit CPU burden.

DISCLOSURE OF THE INVENTION

The object of the present invention is to increase, by a factor of approximately two, the communications capability of an elevator communications system of the two-way ring type.

According to the present invention, in a two-way ring elevator communications system, characterized in that a controller is associated with each elevator to process inter-elevator messages and the controllers of the elevators are linked together in serial fashion on a two-way communications system so that the messages of each controller are passed along to and processed by each of the other controllers in two directions on two independent rings, whichever of the two rings is properly functioning is used at full capacity but if neither ring is properly functioning then both rings are operated at reduced capacity, the reduction being carried out by reducing the time between reassignments of elevator hall calls.

An advantage is that each CPU in the two-way ring communication system has its communications capacity doubled because it is processing and transmitting only one message, according to the invention, rather than two, as taught by the prior art.

BEST MODE FOR CARRYING OUT THE INVENTION

Figure 1:
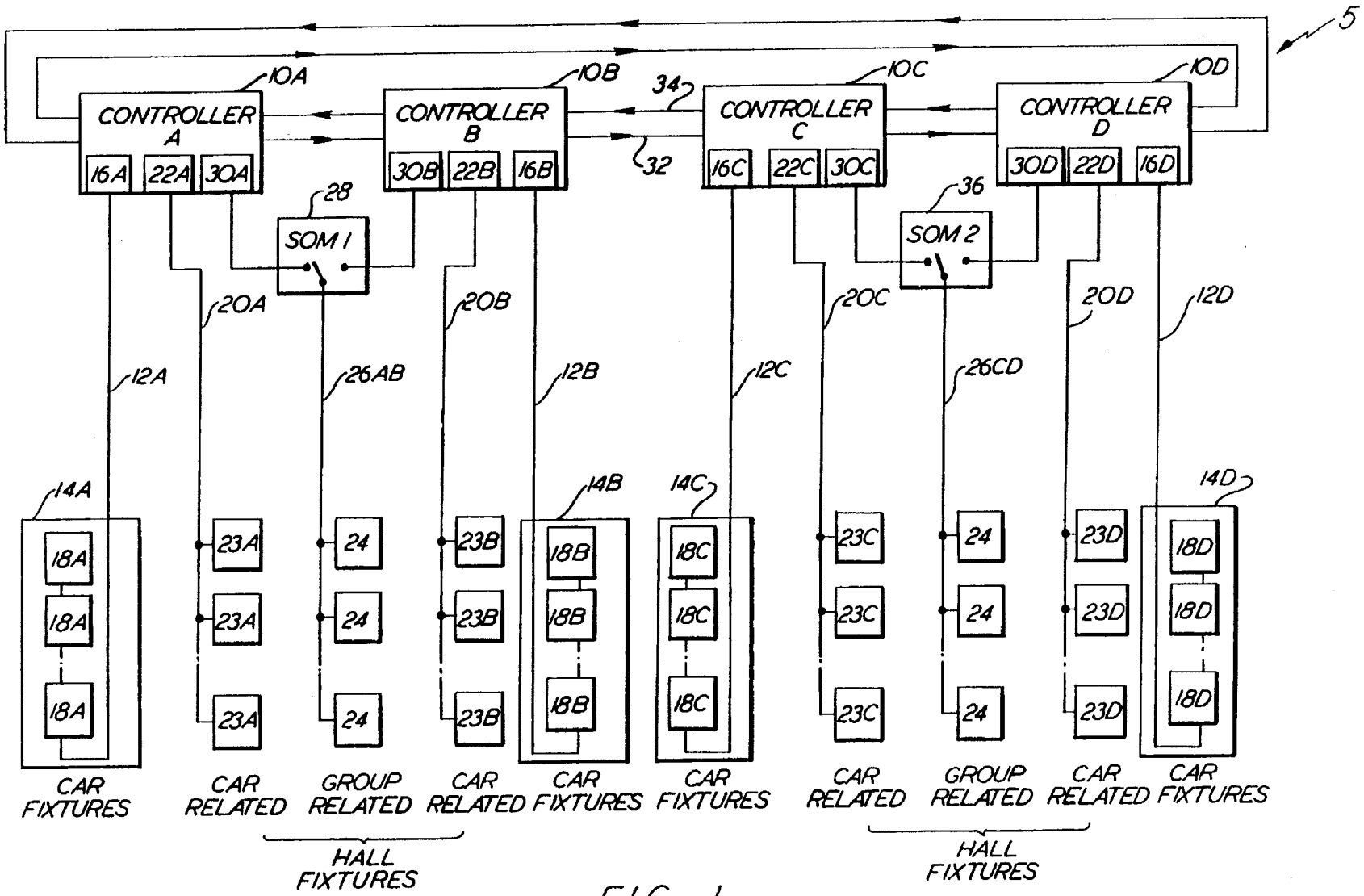
FIG. 1 is a schematic of a two-way ring elevator communications system.

FIG. 1 shows a system architecture of a two-way ring communications system 5 for a four-elevator group. An elevator controller 10A is connected via a serial link 12A to fixtures in the elevator 14A. A master station 16A in the elevator controller 10A, and remote stations 18A in the elevator 14A serve as interfaces to the serial link 12A, and are discussed in detail in commonly-owned U.S. Pat. No. 4,497,391 (Mendelsohn et al., 1985), entitled Modular Operational Elevator Control System. The elevator controller 10A is also connected via a serial link 20A to elevator-related hall fixtures, again via a master station 22A in the elevator controller 10A and remote stations 23A associated with the elevator-related hall fixtures.

Elevator controllers 10B, 10C and 10D are identical to the elevator controller 10A, and are similarly connected via master stations 16B–16D, serial links 12B–12D, and remote stations 23B–23D to elevator fixtures for the elevators 14B–14D; and via master stations 22B–22D, serial links 20B–20D, and remote stations 18B–18D to elevator-related hall fixtures for the elevators 14B–14D. Group-related hall fixtures are linked via remote stations 24 and a serial link 26AB to a switchover module 28 that is operable to provide the signals to/from the master station 30A in the controller 10A. The switching over of the switchover module 28 is discussed in greater detail hereinafter.

The elevator controllers 10A–10D are connected for communication with one another via the two-way communications ring system 5 comprising a first ring 32 providing data serially one way from the controller 10A, to the controller 10B, to the controller 10C, to the controller 10D, to the controller 10C, to the controller 10D, to the controller 10C, to the controller 10C, to the controller 10B, to the controller 10A. Thus, each elevator controller 10A–10D is in direct communication with the next and previous elevator controller on the first ring 32. Messages are passed around the ring 32 under control of each elevator controller, which performs an error check and passes the received message to the next elevator controller only if no errors are detected. This communication concept allows in case of an elevator controller failure is isolation of the faulty controller by the two neighboring elevator controllers. In this event, further communication is ensured due to the two rings 32,34.

It will be noted that a second switchover module 36 receives signals on serial link 26CD from remote stations 24 associated with a second, optional set of group-related hall fixtures, and is operable to provide these signals to/from master stations 30C or 30D in either of the controllers 10C or 10D, respectively. As shown in FIG. 1, the switchover module 36 is providing signals to/from the master station 30C in the controller 10C.

Figure 2:
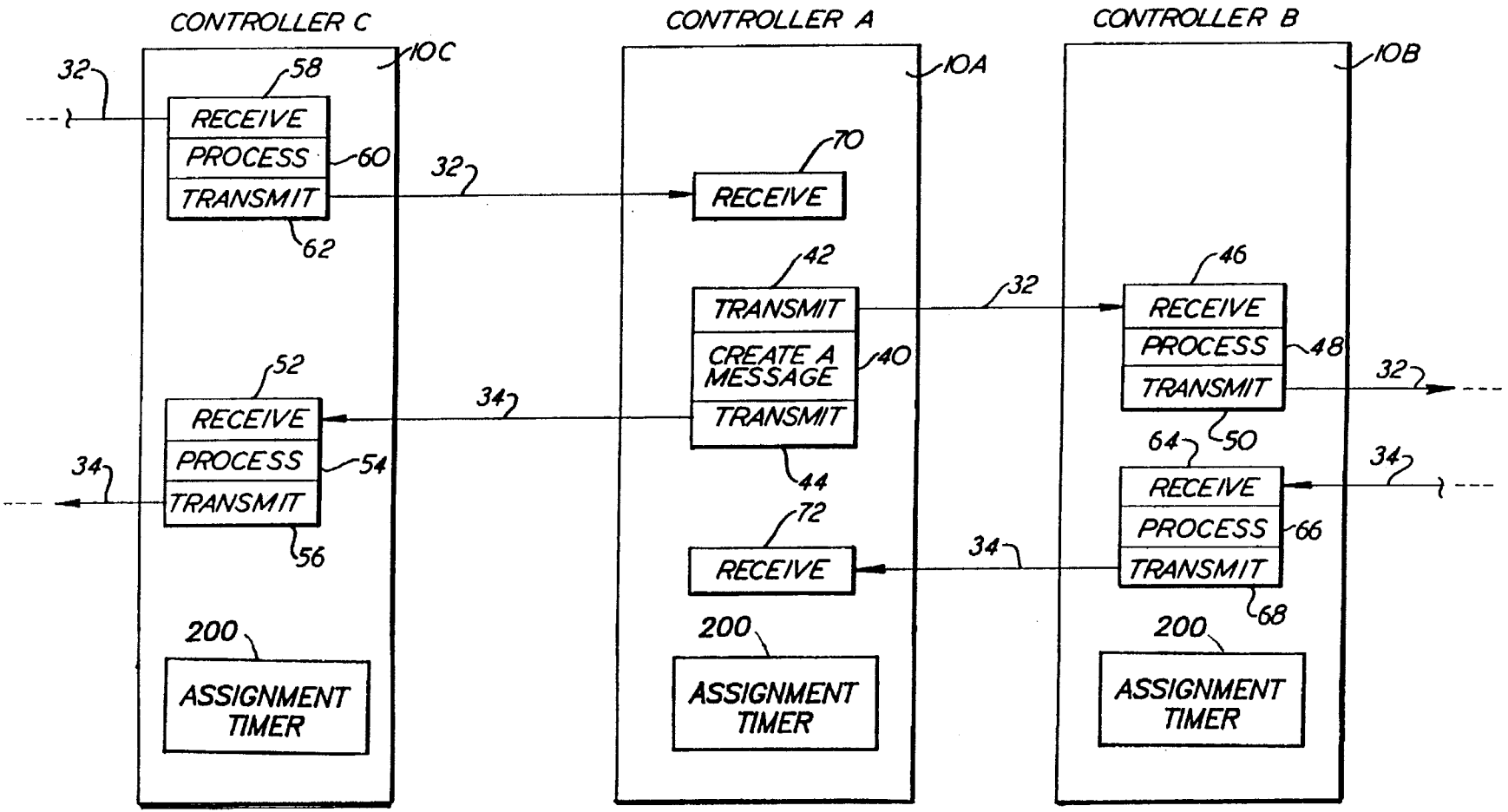
FIG. 2 is a logic diagram showing generally how a message is processed on the two-way ring elevator communication system of FIG. 1.

FIG. 2 shows how a message 40 is processed on the two-way ring communication system 5, for instance in a three elevator group configuration. Assume that the elevator controller 10A creates a new message 40, a status message for example. A leader (or trailer) on the message is indicative of its origin at controller 10A. Controller 10A then transmits 42 the same message 40 to controller 10B in one direction on the ring 32, and transmits 44 the same message 40 to controller 10C in the opposite direction on the ring 34. Controller 10B receives 46 the message 40 on the ring 32 and processes 48 the message 40 which processing includes an error check to detect an invalid message, caused by a transmission error for example. If no errors are detected, controller 10B retransmits 50 the message on the ring 32 to the controllers 10.

In a similar manner, the controller 10C receives 52 the message 40 on the ring 34, processes 54 the message 40, and retransmits 56 the message 40 on the ring 34 to the controller 10B.

The controller 10C receives 58, processes 60, and retransmits 62 the message 40 received on the ring 32 from the controller 10B to the controller 10A, and the controller 10B receives 64, processes 66, and retransmits 68 the message 40 received on the ring 34 from the controller 10C to the controller 10A. The controller 10A receives 70 the message 40 on the ring 32 from the controller 10C, and also receives 72 the message 40 on the ring 34 from the controller 10B, recognizes it (the leader/trailer) and finalizes the transmission.

The communications concept here is based on two rules:

1. Any message originated by one of the elevator controllers 10A–10D has to be received after a "round trip time" needed for the message to travel fully around the ring 32,34, independent of the message destination, before further action is taken. A simple watchdog timer is provided for this purpose.

2. Any message received by one of the elevator controllers 10A–10D is retransmitted again without any modification so long as no errors are detected. If errors are detected, the message is ignored (not retransmitted).

These two rules allow an elevator controller 10A–10D which is an originator of any message to ensure that each elevator 14A–14D has received the same message as long as at least one of the two identical messages 40 are received by the originator after a round trip on the ring 32,34; the implication being that a message that has been transmitted once in two directions on two rings 32,34 has made it at least in one direction around the communications system 5 ring. Furthermore, this concept allows deletion of invalid messages as soon as possible.

The originating elevator controller may not receive either of the two identical messages, this can be true if both rings 32,34 are interrupted, by a faulty elevator for example. In this case, the same message 40 is transmitted in the two directions once again after a timeout period. After the next timeout period, the originator then assumes that each elevator has received the message 40. This assumption is acceptable because the two-way ring communications system 5 allows in case of an interrupted ring 32,34 that each elevator controller 10A–10D can be reached by the originator in at least one of the two directions.

An assignment timer 200 controls the intervals of execution of algorithms for assigning elevators 14A–14D to hall calls.

Figure 3:
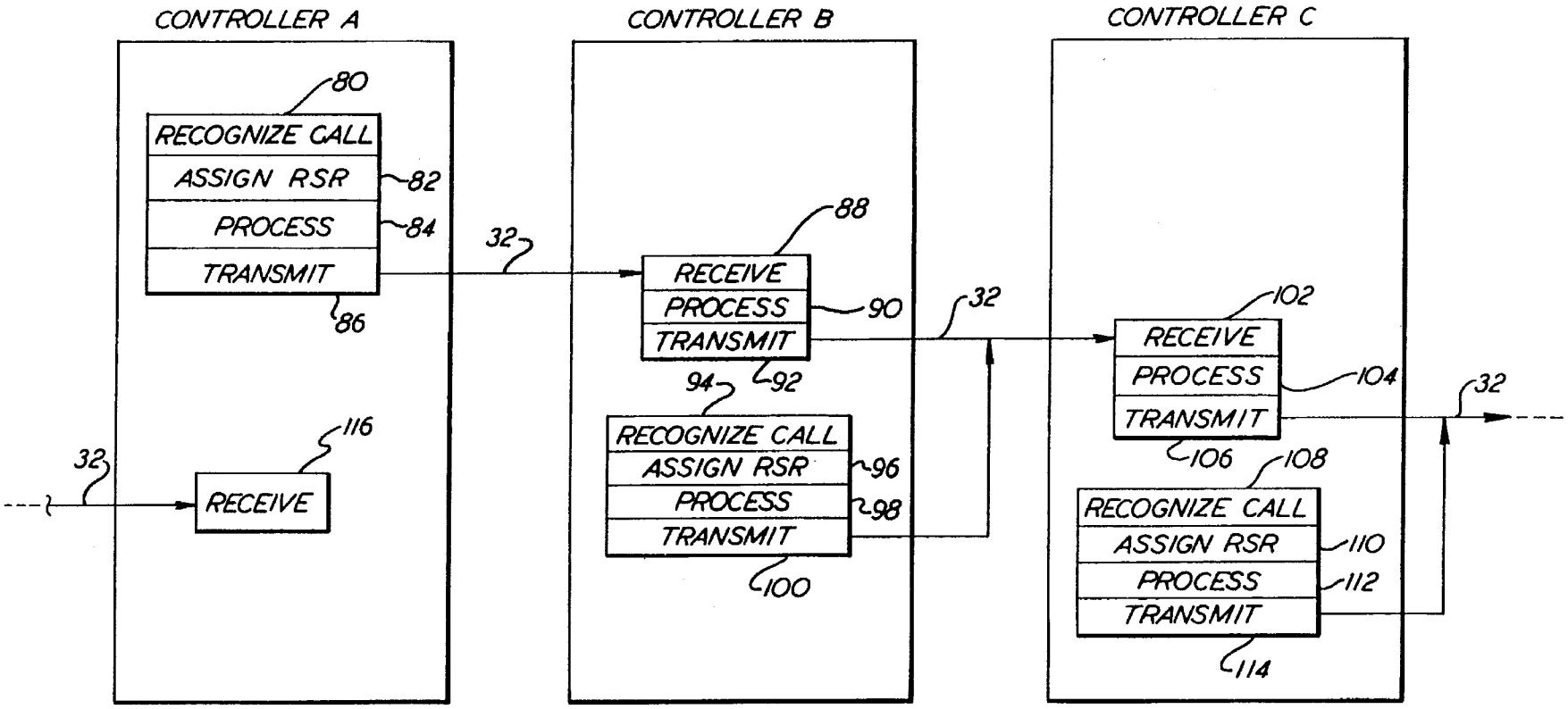
FIG. 3 is a flow chart for execution by each CPU of each node on the ring communications system of FIGS. 1,2 for determining whether to transmit messages on one or two rings.

FIG. 3 shows the different steps performed to dispatch or to redispatch a hall call on the two-way ring communication system 5 for a three elevator group.

Assume that elevator controller 10A is connected (via the switchover module 28 to the group-related hall fixtures and receives a hall call request, or that elevator controller 10A initiates a hall call service. Elevator controller 10A creates a hall call message which includes the steps: recognize the hall call 80, calculate the Relative System Response (RSR) value for the elevator 14A 82, and processes the message for transmission 84. (The RSR value is a measure of how long it would take for an elevator to respond to a call). It (10A) then transmits 86 a hall call response message.

The following steps performed to process the hall call response message on the rings 5 are according to the communication concept described with regard to FIG. 2. The controller 10B receives 88, processes 90, and retransmits 92 the hall call response message received from the controller 10A. Then, the controller 10B creates its own hall call response message by recognizing the hall call 94, assigning an RSR value to it 96 for the elevator 14B, processing a second hall call response message 98, and transmitting 100 that second hall call response message around the ring 32. Similarly, the controller 10C receives 102, processes 104, and retransmits 106 the hall call response messages from the controllers 10A and 10B on the ring 32, and creates its own third hall call response message by recognizing the hall call 108, assigning an RSR value to it 110 for the elevator 14C, processing 112 a third hall call response message, and transmitting 114 the new third hall call response message around the ring 32. The controller 10A receives 116 the hall call response messages from the controllers 10B and 10C. Thus, it is seen that all three controllers have access to all three hall call response messages.

After each controller (A, B, C) has received the hall call response messages of the other controllers in the group, each controller (A, B, C) is able to independently decide which elevator 14A–14C is the best and which will respond to the hall call. The time required to make the decision, and make the same decision, as to which elevator responds to the hall call depends on the number of elevators in a group and the number of total messages of all types which are being processed on the two-way ring communications system 5. A typical value is approximately 30 milliseconds for a three elevator group configuration. Thus, it is evident that both elevator and group functions are performed in each controller 10A, 10B and 10C.

Figure 4:
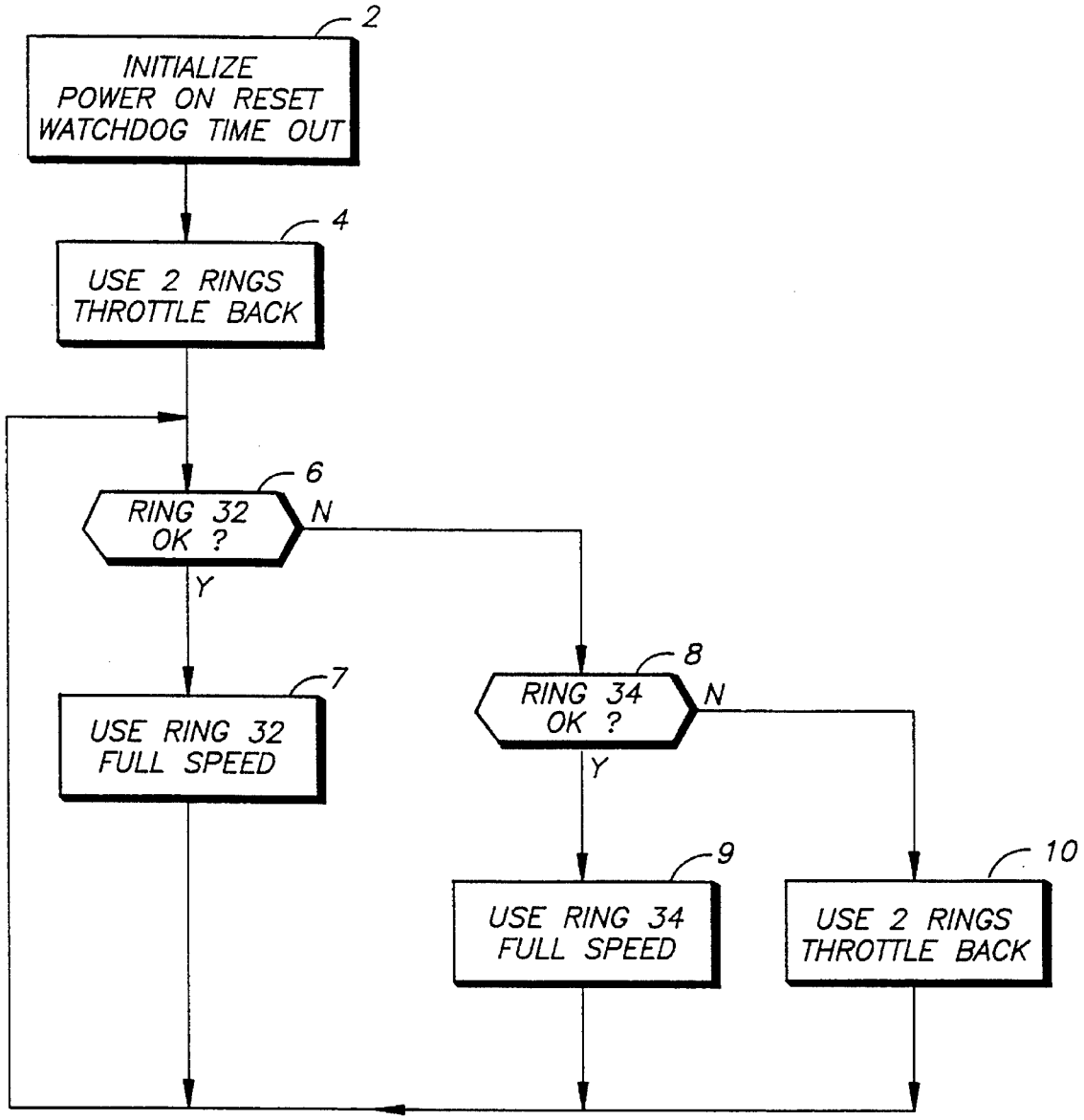
FIG. 4 is a table for selection of a hall call reassignment interval.

The routine illustrated in the flow chart of FIG. 4 is executed by each elevator controller 10A–10D on the rings 32, 34. FIG. 4 incorporates the present invention for selecting whether to transmit messages on ring 32, ring 34 or both. Initialization is caused by power-on-reset or expiration of a watchdog time step 2. Either condition causes an elevator controller 10A–10D to select transmission on both rings 32,34 Step 4. Next, each ring 32,34 is tested for proper functioning. Verification of the proper functioning is done through transmission of the status message every 0.5 seconds. If an elevator controller 10A–10D on a ring 32,34 receives back its own message on a ring 32 or 34, then that ring 32 or 34 is one way.

A first-ring-good signal is provided if the ring 32, is okay whereas a second-ring-good signal is provided if the second ring 34 is okay; a first-ring-bad signal is provided if the first ring 32 is determined to be faulty whereas a second-ring-bad signal is provided if the second ring 34 is determined to be faulty.

First ring 32 is tested, and if okay, is used at full speed while no transmissions are provided on ring 34, Step 6,7. If ring 32 is not found to be okay, then ring 34 is tested, Step 8. If ring 34 is okay then all transmissions are made on ring 34 and none on ring 32, Step 9. If, however, rings 32 and 34 are both faulty, then transmissions are made on both rings 32 and 34 while CPU operation is throttled back, Step 10, as explained more fully below.

Each elevator controller 10A–10D always receives on both rings 32,34. The switching logic in FIG. 4 only involves transmitting. Status messages, which are infrequent, are always transmitted on both rings 32,34. The switching logic is local to each elevator controller 10A–10D. It is not necessary that all elevators 14A–14D be synchronous in their switching decisions.

Throttling back, Step 10, includes decreasing the processing frequency of certain functions carried out by the CPU of an elevator controller. The function which takes the most time is the execution of an algorithm for assigning hall calls to elevators 14A–14D. Examples of such algorithms are U.S. Pat. No. 4,363,381 issued to Bittar, entitled "Relative System Response Elevator Call Assignments" and U.S. Pat. No. 4,815,568 to Bittar, entitled "Weighted Relative System Response Elevator Car Assignment System with Variable Bonuses and Penalties".

Intervals at which these algorithms are executed are controlled by an assignment timer 200, so named because assignment and reassignment of hall calls to elevators occurs each time a reassignment time stored in the assignment timer 200 expires. A typical range of values for the reassignment time is one to ten seconds where one second is very responsive to the passenger waiting for an elevator to respond to his hall call registration. Ten seconds is generally the maximum allowable time before degradation in dispatching of the elevators is noticeable to passengers. This nine second range of values is a large range of time for CPU utilization for nondispatching functions and communications bandwidth. Therefore, it is beneficial to throttle back, Step 10, the system by varying the reassignment time.

Variation of the reassignment time is best done as a function of a number of elevator system performance parameters. Otherwise, the reassignment time may be varied in an elevator system where the CPU utilization is not very great to begin with. An example of an elevator system with no CPU utilization issues is one having a small number of elevators in a building with few floors so that each elevator does not make many stops.

The parameters chosen to effect the reassignment time are listed below.

| PARAMETER | SYMBOL | RANGE |
|---|---|---|
| Number of Cars in a Group | K1 | 1 to 8 |
| Number of Possible Stops | K2 | 2 to 100 |
| Maximum car speed | K3 | 0.5 to 9 m/s |

$aK1 + bK2 + cK3 = f(RT)$

The values A–C in the equation are variable. The final value of the reassignment time is obtained from a look-up table (not shown), relating f(RT) to the parameters to constrain the range of values of the reassignment time to a number between one and ten seconds. Table varies with different type elevators (speed) i.e. different tables for geared/gearless.

Various modifications may be made to the description and the drawings without departing from the spirit and scope of the present invention.

We claim:

1. A method for transmitting messages in an elevator communications system comprising:

providing a two-way ring communications system including a plurality of elevator controllers, said elevator controllers being peers in that none has exclusive control over the operation of the others, each elevator controller providing two serial asynchronous full duplex I/O channels to communicate with the next and previous elevator controllers, each elevator controller having three remote serial link interfaces including one to elevator fixtures, elevator buttons and elevator tell tale lights, another interface to elevator-related hall fixtures and hall lanterns, and a third interface for group-related hall fixtures, hall buttons and hall lights;

checking operation of a first ring of said two-way elevator ring communications system including transmitting from an originating elevator controller a status message to see if said status message is received by said originating elevator controller after traveling around said ring and providing a first-ring-good signal if the status message is received at the originating controller within a watchdog time after traveling around said first ring and providing a first-ring-bad signal if said status message is not received by said originating elevator controller within said watchdog time after traveling around said first ring;

checking the operation of a second of said two-way elevator communications ring system including transmitting a second status message around the ring to see if said second status message is received by said originating elevator controller afar traveling around said second ring and providing a second-ring-good signal if the second status message is so received within said watchdog time and a second-ring-bad signal if said second status message is not so received by said originating elevator controller within said watchdog time;

transmitting on said first ring in response to said first-ring-good signal;

transmitting on said second ring in response to said second-ring-good signal;

transmitting messages on both rings in response to said first-ring-bad signal and second-ring-bad signal; and varying a reassignment time at which assignment of hall calls to elevators is decided, wherein said varying step is provided in response to both said first-ring-bad signal and second-ring-bad signal.

2. A method for transmitting messages in an elevator communications system, comprising:

providing a two-way ring communications system including a plurality of elevator controllers, said elevator controllers being peers in that none has exclusive control over the operation of the others, each elevator controller providing two serial asynchronous full duplex I/O channels to communicate with the next and previous elevator controllers, each elevator controller having three remote serial link interfaces including one to elevator fixtures, elevator buttons and elevator tell tale lights, another interface to elevator-related hall fixtures and hall lanterns, and a third interface for group-related hall fixtures, hall buttons and hall lights;

checking operation of a first ring of said two-way elevator ring communications system including transmitting from an originating elevator controller a status message to see if said status message is received by said originating elevator controller after traveling around said ring and providing a first-ring-good signal if the status message is received at the originating controller within a watchdog time after traveling around said first ring and providing a first-ring-bad signal if said status message is not received by said originating elevator controller within said watchdog time after traveling around said first ring;

checking the operation of a second ring of said two-way elevator communications ring system including transmitting a second status message around the ring to see if said second status message is received by said originating elevator controller after traveling around said second ring and providing a second-ring-good signal if the second status massage is so received within said watchdog time and a second-ring-bad signal if said second status message is not so received by said originating elevator controller within said watchdog time;

transmitting on said first ring in response to said first-ring-good signal;

transmitting on said second ring in response to said second-ring-good signal; and transmitting messages on both rings in response to said first-ring-bad signal and second-ring-bad signal;

varying a reassignment time at which assignment of hall calls to elevators is decided, wherein said varying step is provided in response to both said first ring bad signal and second ring bad signal and said reassignment time is varied as a function of the number of elevator controllers communicating on both said first and second ring, and the number of elevator stops available.

3. A method for transmitting messages in an elevator communications system, comprising:

providing a two-way ring communications system including a plurality of elevator controllers, said elevator controllers being peers in that none has exclusive control over the operation of the others, each elevator controller providing two serial asynchronous full duplex I/O channels to communicate with the next and previous elevator controllers, each elevator controller having three remote serial link interfaces including one to elevator fixtures, elevator buttons and elevator tell tale lights, another interface to elevator-related hall fixtures and hall lanterns, and a third interface for group-related hall fixtures, hall buttons and hall lights;

checking operation of a first ring of said two-way elevator ring communications system including transmitting from an originating elevator controller a status message to see if said status message is received by said originating elevator controller after traveling around said ring and providing a first-ring-good signal if the status message is received at the originating controller within a watchdog time after traveling around said first ring and providing a first-ring-bad signal if said status message is not received by said originating elevator controller within said watchdog time after traveling around said first ring;

checking the operation of a second ring of said two-way elevator communications ring system including transmitting a second status message around the ring to see if said second status message is received by said originating elevator controller after traveling around said second ring and providing a second-ring-good signal if the second status message is so received within said watchdog time and a second-ring-bad signal if said second status message is not so received by said originating elevator controller within said watchdog time;

transmitting only on said first ring in response to said first-ring-good signal;

transmitting only on said second ring in response to said first-ring-bad signal and said second-ring-good signal; and transmitting messages on both rings in response to said first-ring-bad signal and second-ring-bad signal.

4. The method of claim 3, further including the step:

varying a reassignment time at which assignment of hall calls to elevators is decided, wherein said varying step is provided in response to both said first-ring-bad signal and second-ring-bad signal.

5. The method of claim 4, wherein said reassignment time is varied as a function of the number of elevator controllers communicating on said first and second ring, and the number of elevator stops available.

* * * * *